US005083252A

United States Patent [19]

McGuire

[11] Patent Number: 5,083,252

[45] Date of Patent: Jan. 21, 1992

[54] APPARATUS FOR PRODUCING LIGHT DISTRIBUTIONS

[75] Inventor: Kevin P. McGuire, Rochester, N.Y.

[73] Assignee: Tailored Lighting Company, Inc., Pittsford, N.Y.

[21] Appl. No.: 512,436

[22] Filed: Apr. 19, 1990

[51] Int. Cl.[5] ..... F21V 9/00

[52] U.S. Cl. ..... 362/293; 362/2

[58] Field of Search ..... 362/1, 2, 268, 293

[56] References Cited

U.S. PATENT DOCUMENTS 3,093,319 6/1963 Gamain ..... 362/1
3,202,811 8/1965 Hall, Jr. ..... 362/2
4,933,813 6/1990 Berger ..... 362/2

FOREIGN PATENT DOCUMENTS 2724304 12/1978 Fed. Rep. of Germany ..... 362/2

*Primary Examiner*—Stephen F. Husar
*Attorney, Agent, or Firm*—Howard J. Greenwald

[57] ABSTRACT

An apparatus for providing a light distribution which can simulate any desired lighting condition such as, for example, daylight, blackbody radiation, and the like. The apparatus contains a lighting source which provides polychromatic light. The polychromatic light is then dispersed into its constituent frequencies, the dispersed light is then selectively attenuated, and the selectively attenuated light is then converted into light composed of randomized spectral frequencies.

5 Claims, 8 Drawing Sheets

APPARATUS FOR PRODUCING LIGHT DISTRIBUTIONS

FIELD OF THE INVENTION

An apparatus which can produce any specified light distribution such as, e.g., daylight, skylight, monochromatic light, blackbody radiation, and the like.

BACKGROUND OF THE PRIOR ART

Many attempts have been made to simulate natural daylight by artificial means. It has been claimed, with some justification, that natural daylight is the preferred lighted environment. Thus, for example, in form 00112 8809L 150M (1990), the Duro-Test Corporation (of 9 Law Drive, Fairfield, N.J.) states that a good simulation of natural daylight " . . . encourages people to perform as never before because it promotes good vision . . . People see better and work better . . . " Thus, in form 0090 (1988), the Duro-Test Corporation states that light which " . . . simulates natural daylight . . . " is " . . . the perfect interior lighted environment . . . "

The Duro-Test Corporation markets the "VITA-LITE" fluorescent tube, which is described in U.S. Pat. No. 3,670,193. However, notwithstanding the claims of Duro-Test Corporation, such fluorescent tube is not a very good approximation of daylight. The light spectra obtainable from this fluorescent tube contains many high-energy, narrow-wavelength energy "spikes" with widths of less than 10 nanometers in the visible spectrum which do not appear in the spectrum of daylight and which adversely affect correct color perception by human beings. It appears that the spikes in the spectrum obtainable with this fluorescent tube within the visible spectra have a relative energy at least about 800 percent as great as the mean output of the lamp. By comparison, with natural daylight, the "spikes" or undulations in the spectrum are no greater than about 10 percent of the mean relative energy of the spectra.

Many other people have attempted to artificially simulate the spectrum of daylight, to no avail. Thus, for example, Westgate Enterprises (of 11988 Wilshire Blvd., Suite 104, Los Angeles, Calif.) markets a lamp called "CHROMALUX." Although this lamp produces a spectrum which does not contain as many high-energy "spikes" as the "VITA-LITE" lamp, it also does not produce a full spectrum; because it uses a neodymium dopant in the light envelope, the yellow portion of the spectrum (and other portions of the spectrum) is absent. Thus, in a 1990 brochure distributed by Westgate Enterprises, it is stated that "CHROMALUX is made of hand-blown glass containing neodymium . . . Neodymium is able to absorb yellow and other dulling portions of the spectrum."

In order to simulate daylight's spectrum, one must provide a full, even, and accurate distribution of light across the visible spectrum. The prior art discloses that this task is difficult, if not impossible. Thus, in Gunter Wyszecki's "Color Science: Concepts and Methods, Quantitative Data and Formulae," Second Edition (John Wiley & Sons, New York, 1982), it is stated (at pages 147–148) that " . . . the CIE has made no recommendations of artificial sources to realize any of the CIE illuminants D. The difficulty lies in the unique and rather jagged spectral distribution of daylight . . . No artificial sources with such spectral distribution are known, and modifying the spectral distributions of existing sources by placing filters in front of them or using other means has only been partially successful . . . " Thus, e.g., in D. L. MacAdam's "Color Measurement: Theme and Variations" (Springer-Verlag, New York, 1981), the author refers to the CIE's D65 illuminant, which is the standard spectra for daylight; at page 30, he states that " . . . the disadvantage of D65 is that no source of such light, except daylight itself, is available. Several artificial sources have been developed, but none gives a very close approximation to the CIE D65 . . . "

It is desirable to be able to simulate other daylight spectra, besides the D65 spectra. Thus, as is well known to those skilled in the art, the spectra of daylight will vary depending upon the daylight upon atmospheric conditions and solar altitude; see, e.g., S. T. Henderson's "Daylight and Its Spectrum," Second Edition(-John Wiley & Sons, New York, 1977), the disclosure of which is hereby incorporated by reference into this specification.

It is also desirable to be able to simulate blackbody radiation in order, e.g., to calibrate light detectors. As is known to those skilled in the art, a blackbody is an ideal energy radiator which, at any specified temperature, emits in each part of the electromagnetic spectrum the maximum energy obtainable per unit time form any radiator due to its temperature alone and which also absorbs all of the energy which falls upon it. See, for example, the McGraw-Hill Encyclopedia of Science and Technology (McGraw-Hill Book Company, New York, 1977), particularly Volumes 2 (page 278), 6 (pages 419–423), and 7 (pages 55–56).

It is an object of this invention to provide an apparatus which is capable of producing a spectra simulating various daylights which spectra is substantially even and does not contain high-energy "spikes".

It is a further object of this invention to provide an apparatus which is capable of producing a full spectra which accurately simulates various daylights and which does not omit substantial portions of the visible spectrum.

It is a further object of this invention to provide an apparatus which is capable of simulating the spectra of other electromagnetic radiation, such as blackbody radiation, incandescent lights, monochromatic light, polychromatic light, and the like.

SUMMARY OF THE INVENTION

In accordance with this invention, there is provided an apparatus for producing a light distribution. In one preferred embodiment, the apparatus contains a light source which provides a full spectrum of light, a light guide, a means for dispersing the full spectrum of light into individual wavelength components, a means for filtering selected portions of the wavelength components, and a means for combining individual wavelength components into the desired light spectra.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

Figure 1:
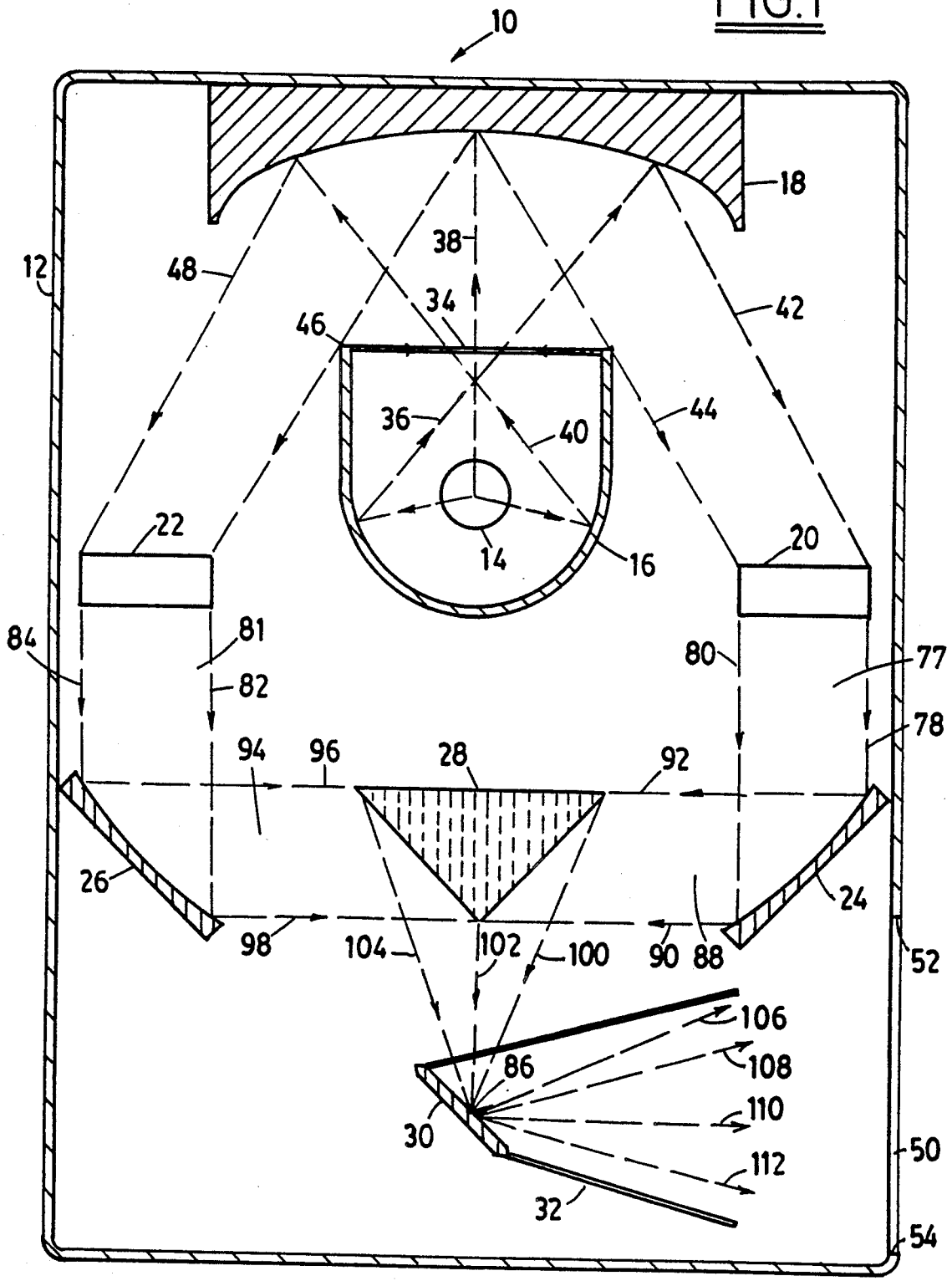
FIG. 1 is a schematic of one preferred embodiment of the invention.

FIG. 1 illustrates one of the preferred embodiments of this invention. Referring to FIG. 1, light simulator 10 is comprised of case 12, light source 14, light guide/-focusing element 16, dispersing element 18, filtering mechanisms 20 and 22, focusing elements 24 and 26, light combining means 28, diffuser 30, and light guide 32.

Case 12 of light simulator 10 may be constructed in any conventional manner of conventional material. It may be construced from metal, plastic, glass, and the like. In one preferred embodiment, case 12 is constructed of sheet metal.

Light source 14 may be any light source(s) which preferably provides a full spectrum of light. As used in this specification, the term full spectrum of light is a spectrum which contains no voids. Thus, when a plot of the spectrum (in watts versus wavelength) is made, such plot will be a continuous line above the abscissa for a continuous spectrum of light. By comparison, when one plots the spectrum of the light from the "CHROMA-LUX" lamp, a discontinuous series of line(s) is obtained.

In one embodiment, the light source 14 provides a continuous spectrum of light from about 10 nanometers to about 380 nanometers, thus providing light in the ultraviolet spectrum. In another preferred embodiment, the light source 14 provides a continuous spectrum of light from about 380 to about 780 nanometers, providing visible light. In another embodiment, the light source 14 provides a continuous spectrum of light from about 780 nanometers to about 10,000 nanometers, providing light in the near infrared range. In another embodiment, the light source 14 provides a continuous spectrum of light from about 10,000 nanometers to about 1,000,000 nanometers, thus providing light in the far infrared range. It is to be realized that the light source 14 may provide a continuous source of light which overlaps or extends over more than one of these ranges. Thus, by way of illustration, the light source may provide continuous light from about 10 to about 1,000,000 nanometers from a source such as, e.g., a low-voltage, incandescent lamp.

In one embodiment, an incandescent lamp which radiates energy at wavelengths between 380 nanometers to 1,000,000 nanometers microns is used. Such a lamp is described at pages 115–116 of the McGraw-Hill Encyclopedia of Science and Technology, supra.

In another embodiment, a hydrogen lamp (also known as a deuterium lamp) which radiates energy at wavelengths between about 10 to about 380 nanometers may be used.

One may use any of the radiation sources known to those skilled in the art as light source 14. Thus, by way of illustration and not limitation, one may use any of the light sources described in U.S. Pat. No. 4,536,832 of Lemmons such as, e.g., the HMI metal halide lamp, the CSI metal halide lamp, the CID metal halide lamp, the carbon arc lamp, the mercury arc lamp, the xenon arc lamp, and the like. Thus, e.g., one may use fluorescent lamps. Thus, e.g., one may use the light sources described in U.S. Pat. No. 1,845,214 of Arrousez, U.S. Pat. No. 3,379,868 of Richardson, U.S. Pat. No. 2,057,278 of Richardson, and German Utility Model No. 1,744,824. The disclosure of each of said U.S. patents and of said German patent is hereby incorporated by reference into this specification.

Light source 14 may be comprised of only one lamp. Alternatively, light source 14 may be comprised of at least two lamps, each of which radiates a different light spectrum. In yet another embodiment, light source 14 is comprised of at least three lamps, each of which radiates a different light spectrum.

In the embodiment where light source 14 is comprised of two or more lamps, any of these lamps may radiate a discontinuous light spectra as long as the combination of lamps used as source 14 provides a continuous spectra. Thus, e.g., one may use a combination of hydrogen and tungsten-halogen lamps.

In another embodiment, only one lamp is used as light source 14 and it is a tungsten-halogen lamp. These lamps are well known to those skilled in the art. Thus, for example, illuminant produced by these lamps (known as CIE illuminant A) is described on page 30 of D. L. MacAdam's "Color Measurement . . . ," supra. One preferred tungsten-halogen lamp is Sylvania's ANSI code FCL 58856, which is rated at 120 volts, has a color temperature of 3,000 degrees Kelvin, produces 10,000 lumens, and has filament class C8.

It is preferred that light source 14 have a substantially constant output over its period of use; for every frequency, the output should be better than within 0.1 percent of the initial value. Thus, in one embodiment, not shown, the spectra impinging upon filtering mechanism 20 and/or 22 may be measured and monitored by a linear array detector (not shown); this linear array detector should preferably detect radiation at least about every 10 nanometers to determine the spectra. Upon detecting any change in the spectra emanating from lamp 14, the linear array detector, via an electrical connection to a power supply connected to lamp 14 and/or to the filtering mechanisms 20 and/22, may make appropriate changes in the light transmitted from filters 20 and/or 22.

It is preferred that the light source 14 be enveloped by a clear envelope rather than one which has a diffused surface.

The light from light source 14 focused into aperture 34 by light guide/focusing element 16. In one preferred embodiment, light guide/focusing element 16 is a reflector.

It is preferred that light guide/focusing element 16 be an aluminum-coated reflector. Any aluminum-coated reflector 16 known to those skilled in the art may be used. Thus, by way of illustration and not limitation, one may use the reflectors described in William B. Elmer's "The Optical Design of Reflectors," Second Edition (John Wiley and Sons, New York, 1980), the disclosure of which is hereby incorporated by reference into this specification. It is preferred that the reflector used be elliptical; see, e.g., pages 89–91 of said Elmer book for a discussion of elliptical reflectors.

It is preferred that the interior surface of reflector 16 be sufficiently flat so that the angle between a reflected ray and the reflecting surface is equal and opposite to the angle of ray incidence. The flatness of such interior surface may be measured by means well known to those skilled in the art. Thus, in one preferred embodiment, the interior surface of reflector 16 is a specular surface.

The term specular surface, as used in this specification, refers to a microscopically smooth and mirrorlike surface without any noticeable diffusion. See, for example, pages 25–26 of said Elmer book.

Referring again to FIG. 1, light rays 36, 38, and 40 are transmitted through aperture to dispersing element 18.

Dispersing element 18 spatially separates polychromatic light (white light) into its constituent optical frequencies by a combination of constructive and destructive interference, or by varying the optical path lengths. As is well known to those skilled in the art, many different materials and/or structures and/or methods may be used to separate such light rays into their respective wavelengths. Thus, e.g., one may use one or more prisms, ruled blazed diffraction gratings, multiple slits, holographic gratings, and the like.

In one preferred embodiment, dispersing element 18 is a diffraction grating. In an even more preferred embodiment, shown in FIG. 1, element 18 is a concave holographic diffraction grating. Such gratings are well known to those skilled in the art and are described in, e.g., (1)H. Noda et al., "Geometric Theory of the Grating," Journal of the Optical Society of America, Volume 64, Number 8, August, 1974; (2) "Solutions to Spectroscopic Problems: Plane Diffraction Gratings" (published by American Holographic Company, Littleton, Mass., June 1986); (3) "Solutions to Spectroscopic Problems: Concave Diffraction Gratings" (published by American Holographic Company, Littleton, Mass., 1986); and (4) Henry A. Rowland, "On Concave Gratings for Optical Purposes" (Philosophical Magazine, Vol. XVI Series 5, September 1883, page 197). The disclosure of each of the Noda et al., American Holographic, and Rowland references is hereby incorporated by reference into this specification.

As is known to those skilled in the art, the concave diffraction grating (also known as the concave holographic grating) combines the functions of optical imaging and diffraction into one optical element. It is preferred that the diffraction grating be a flat field concave holographic grating. These diffraction gratings may be purchased from, e.g., the American Holographic Company. Referring to said Company's June 1, 1986 catalog ("Solutions to Spectroscopic Problems: Concave Diffraction Gratings," supra), any of the flat field gratings listed in Table 1 (on page 4 of the catalog) may be used as dispersing element 18. Thus, one may use the grating from such Table with a linear dispersion of 10 nanometers per millimeter which is identified as catalog number 450.02.

Referring again to FIG. 1, light rays 36, 38, and 40 and both refracted and reflected by concave holographic diffraction grating 18 so that a multiplicity of light rays are caused to impinge upon filtering mechanism 20 between boundaries 42 and 44; and a similar multiplicity of light rays are caused to impinge upon filtering mechanism 22 between boundaries 46 and 48. Each of these multiplicity of light rays may be partially or completely attenuated by the filtering element and/or detected by a linear array detector.

As is well known to those skilled in the art, diffraction grating 18 separates each incoming light beam (such as, e.g., light beam 38) into one or more orders, in accordance with the grating equation described in the June 1, 1986 American Holographic publication entitled "Solutions to Spectroscopic Problems: Plane Diffraction Gratings", supra (see page 1). Also see J. M. Lerner's "Diffraction gratings ruled and holographic—a review," (International Society of Optical Engineers, SPIE. Vol. 240, Periodic Structures, Gratings, Moire Patterns and Diffraction Phenomena [1980]), the disclosure of which is hereby incorporated by reference into this specification. Thus, for example, referring again to FIG. 1, light ray 38 will be separated by grating 18 into order $+1$ (the light beam defined by boundaries 42 and 44) into order $-1$ (the light beam defined by boundaries 46 and 48), and into order 0 (which is light beam 38 being reflected back onto itself).

The diffraction grating also produces diffracted orders greater than 1; and, in one embodiment, these higher orders may also be caused to impinge upon one or more filtering mechanisms. In the embodiment shown in FIG. 1, however, these higher orders are allowed to be absorbed by the interior surfaces of case 12.

In one preferred embodiment, not shown, a linear array detector is disposed at filtering element 20 and/or 22, as an integral part thereof. This linear array detector may be operatively connected to an anlayzer (not shown) which is able to continually monitor the spectrum of the light rays from diffraction grating 18 and determine whether they have changed. When the analyzer determines that the spectrum of the light rays from diffraction grating 18 has changed substantially, then it may make appropriate adjustments in the power supply (not shown) connected to light source 14 and/or filter 20 and/or filter 22 to insure that the light rays passing through filters 20 and 22 continue to have substantially the same spectral distribution. By means of this feedback arrangement, the light spectra provided by apparatus 10 remains substantially constant at output 50 (which occurs between points 52 and 54).

Any of the linear array detectors known to those skilled in the art may be used in apparatus 10. Thus, by way of illustration, one may use the linear array detectors described in the 1989 "Laser Focus Buyers' Guide" (Penwell Publishing Company, Advanced Technology Group, Westford, Ma. 01866), pages 272–274, and in "The Photonics Design & Applications Handbook," Book 3, 35th Edition, 1989 (Laurin Publishing Company, Inc., Berkshire Common, Pittsfield, Ma. 01202), at pages 84–85. The disclosure of each of these publications is hereby incorporated by reference into this specification.

In one embodiment, the linear array detector used is a 35 element Hamamatsu detector equipped with a $4.4 \times 0.94$ millimeter active area quartz window (available from Hamamatsu Corporation, 360 Foothill Road, Bridgewater, N.J.).

Two filtering mechanisms, 20 and 22, are shown in the preferred embodiment illustrated in FIG. 1. However, as will be apparent to those skilled in the art, the apparatus may contain only one of said mechanisms. It is preferred that the mechanism contain at least two such filtering mechanisms.

Each of filtering mechanisms 20 and 22 is adjustable; and, depending upon the adjustment made, may attenuate none, some, or all of the light rays impinging upon them.

Any of the adjustable attenuating mechanisms known to those skilled in the art may be used as filtering mechanisms 22 and/or 22. Each of these mechanisms should be provided with means for adjusting the degree and amount of attenuation provided by the device. As will be apparent to those skilled in the art, depending upon the mechanism of attenuation used by the device, different adjustment will be used.

By way of illustration, one may use liquid crystal light valves for filtering mechanisms 20 and/or 22. These valves are readily available to those skilled in the art and may be purchased, e.g., from the companies listed on page 205 of said 1989 "Laser Focus World Buyer's Guide," supra.

One may also use electro-optic modulators and/or acousto-optic modulators for filtering mechanisms 20 and/or 22. These modulators may be purchased from the manufacturers described on page 206 of said "Laser Focus World Buyers' Guide."

One may use Faraday-cell modulators for filtering mechanisms 20 and/or 22. These modulators may be purchased from the vendors listed on page 208 of said "Laser Focus World Buyers' Guide."

As will be apparent to those skilled in the art, any device which attenuates light may be in apparatus 10. Thus, in one preferred embodiment, mechanical means may be used to selectively and adjustably attenuate the light diffracted from grating 18.

In one embodiment of such mechanical means, not shown, each of filters 20 and 22 is comprised of a solid aperture and an adjustable shutter which may be positioned to cover none, part, or all of said aperture. The shutter may be of any desired shape or size; and its shape and size and the degree to which it covers the aperture will dictate the amount and type of attenuation. The shutter may be solid, it may be comprised of orifices or slits, and the like.

By way of illustration, one may use an electromechanical shutter such as, e.g., model SD-1032 sold by Vincent Associates of Rochester, N.Y. Other manufacturers of suitable electromechanical shutters are listed on page 220 of said "Laser Focus World Buyers' Guide."

Thus, e.g., one may use the electro-optic shutters sold by those manufacturers listed on page 220 of said "Laser Focus World Buyers' Guide." One such suitable electro-optic shutter is model number 380-M available from Conoptics, Inc. of Danbury, Conn.

Figure 2:
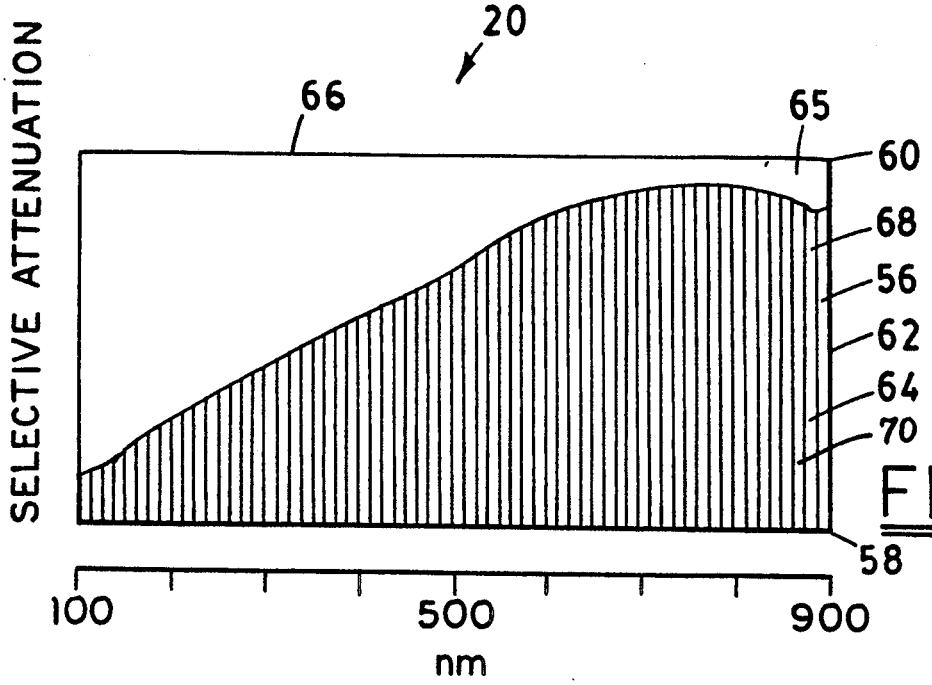
FIG. 2 is a depiction of an aperture containing a multiplicity of light attenuating means configured in a manner designed to produce a certain spectrum.
Figure 3:
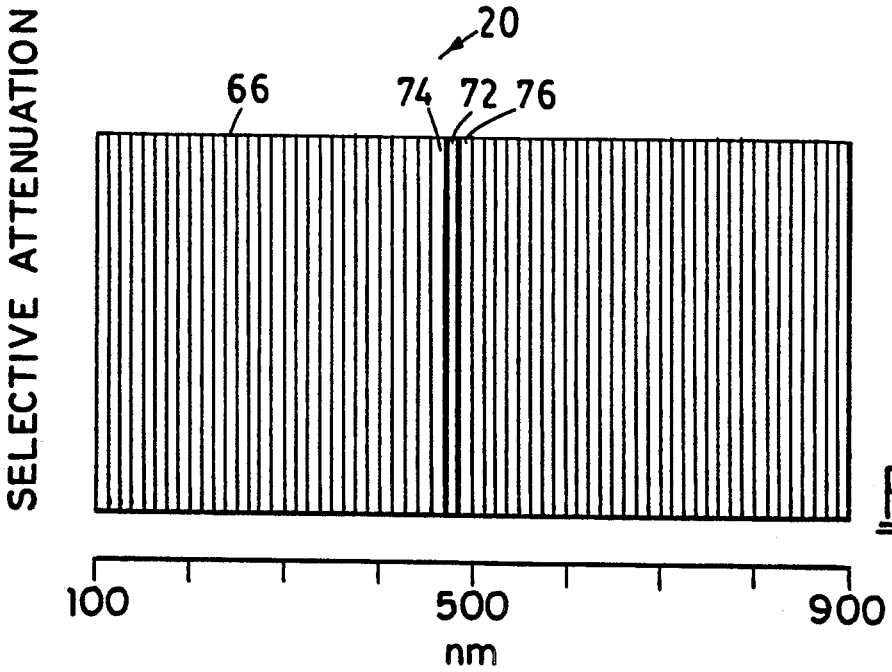
FIG. 3 is a depiction of an aperture containing a multiplicity of light attenuating means configured so as to block all light except that in one specified band.

One unique mechanical shutter which may be used in filter mechanism 20 and/or 22 is illustrated in FIGS. 2 and 3. Each of these shutters 20 is comprised of a multiplicity of adjustable apertures, each of which comprises an adjustable rod in a guide.

Referring to FIG. 2, shutter 20 is comprised of rod 56, The height of rod 56 may be adjusted so that it has essentially no height (at point 58), its height is 100 percent of the height of the aperture (at point 60), or its height is somewhere between 0 and 100 percent of the height of the aperture (see point 62, e.g.).

The height of rod 56 may be adjusted by conventional means (not shown). Thus, by way of illustration, rod 56 is preferably disposed in rod guide which allows movement in an up-and-down manner. Rod 56 may be moved, e.g., by hand, by template, by motor, and by any other conventional means well known to those skilled in the art.

The preferred surface 64 of rod 56 is provided with light absorbing means so that, when light impinges upon rod 56, it will neither be reflected back to its source or pass through the shutter.

Thus, referring again to FIG. 2, rod 56 will allow light to pass in the space 65 between it and the aperture 66. The extent to which rod 56 is moved up or down in aperture 66 will dictate how much light is allowed to pass above it.

Rod 56 is contiguous with rod 68, which in turn is contiguous with rod 70, etc. These contiguous rods, each of which prefrably contains an absorptive surface, provide a continuous barrier to the passage of light. By varying the height of the rods in the aperture 20, one may vary the distribution of light which passes through the aperture.

FIG. 3 illustrates a mechanical shutter in which each of the adjustable rods, except for rod 72, has a height which is substantially 100 percent of the height of aperture 66. Whereas FIG. 2 illustrates the arrangement one may use to obtain a typical daylight distribution, the embodiment of FIG. 3 illustrates how to obtain a monochromatic distribution. In this latter embodiment, rod 72 has a height which is 0 percent of the height of such aperture. A thin beam of light will be allowed to pass through the space between rods 74 and 76. All of the other light which impinges upon filter 20 will be absorbed by the extended rods.

The resolution obtainable with filter 20 will vary with the width of the rods in aperture 66. Each of the rods used in the apertures 66 may be of the same width. Alternatively, one or more rods may have a different width.

The mechanical shutters illustrated in FIGS. 2 and 3 may be controlled either manually or automatically. In one preferred embodiment, means for adjusting mechanical shutters in filter mechanisms 20 and/or 22 are electrically connected to a computer which, in response to certain stimuli, automatically and continuously changes the profile of the rods and the light transmitted by the shutter.

The rods in filter mechanisms 20 and 22 may be so adjusted that the bands of light passing through them have the same distribution. Alternatively, they may be adjusted so that such bands have different light distributions.

The band of light 77 passing through filter mechanism 20 is defined by boundaries 78 and 80. The band of light 81 passing through filter mechanism 22 is defined by boundaries 82 and 84. Each of these bands is caused to impinge upon a concave reflector, band 77 impinging upon reflector 24 and band 81 impinging upon reflector 26.

Focusing elements 24 and 26 are well known to those skilled in the art; and they may be readily purchased, e.g., from an optical supply company such as Janos Technology, Inc. of Townshend, Vt. Each of these elements 24 and 26 is comprised of a concave spherical reflecting surface; and its interior surface is curved like a segment of the interior of a circle or sphere.

As is known to those in the art, a spherical reflecting surface has image-forming properties similar to those of a thin lens or of a single refracting surface. The image from a spherical mirror is in some respects superior to that of a lens, notably in the absence of chromatic effects due to dispersion that always accompany the refraction of white light.

Focusing elements 24 and 26, in combination with light combining means 28, provide a means for focusing the bands of light 77 and/or 81 substantially at one point. Thus, it is preferred that elements 24 and 26 be concave reflecting mirrors to minimize chromatic effects due to dispersion.

In one preferred embodiment, focusing elements 24 and 26 are specular reflectors which are aluminum coated; and, in this embodiment, their exterior surfaces are sufficiently flat so that the angle between a reflected ray and the reflecting surface is equal and opposite to the angle of ray incidence.

Referring again to FIG. 1, a band 88 of light will be reflected from focusing element 24; and it will be bounded by boundaries 90 and 92. Similarly, a band 94 of light will be reflected from focusing element 26; and it will be bounded by boundaries 96 and 98. Bands of light 88 and 94 are caused to impinge upon light combining element 28, which causes such light bands to combine into substantially one spot of light focused substantially at point 86.

Any of the light combining elements well known to those in the art may be used as element 28. Thus, one may use a simple prism, a combination of plano mirrors, and the like.

In one preferred embodiment, element 28 is a specular-reflecting aluminum-coated prism obtainable from Janos Technology, Inc.

Light beams 100, 102, and 104 are caused to combine at substantially point 86, which is part of the surface of diffuser 30. By diffusing the combined light at point 86, it is prevented from separating into its individual wavelengths; diffuser 30 scatters the light beams into rays 106, 108, 110, and 112.

Any of the diffusers known to those skilled in the art may be used. As is known to those skilled in the art, a diffuser causes a reflection or refraction of light from an irregular surface, or an erratic dispersion through a surface. Thus, one may use such irregular surfaces as opal glass, bead-blasted glass, frosted glass, frosted translucent plastic, or the like.

Diffusers are readily available to those skilled in the art. Thus, e.g., they may be purchased from Oriel Corporation of Stratford, Conn.

In one preferred embodiment, the surface of diffuser 30 consists of a glass beaded screen surface obtainable from DaLite Screen Co., Inc. of Warsaw, Ind. To produce this material, a special chemical coating is applied to the glass beads to make them non-hydroscopic.

In another preferred embodiment, the diffuser 30 is an integrating sphere. As is known to those skilled in the art, an integrating sphere is a spherical body with an internal diffuse reflecting surface which has an entrance pupil optically oriented 90 degrees to the exit pupil; light coming into the entrance pupil is diffusely reflected by the back surface of the sphere to all of the other surfaces defined by the sphere until a portion of it exits through the exit pupil. These integrating spheres are readily available and are sold, e.g., by United Detector Technology of Hawthorne, Calif.

Referring again to FIG. 1, one may use light guide 32 to guide light rays 106, 108, 110, and 112 and to insure that they are not trapped by the interior walls of casing 12. Alternatively, or additionally, one may place a lens (not shown) in front of point 86 to direct such light rays. Alternatively, or additionally, one may place a sensor in front point 86 to determine the distribution of such light rays and, by means of a suitable feedback circuit(not shown), change the power supplied lamp 14, the configurations of one or more of the apertures in filter 20 and/or filter 22, and/or other properties of the system which affect the light distribution.

In one embodiment, not shown, the feedback circuit affects the transmission properties of the grating 18 and/or the reflective properties of the reflector 16 and/or the reflective properties of mirrors 24, 26, and 28 and/or the diffusing properties of diffuser 30. As is well known to those skilled in the art, the optical properties of certain optical elements may vary with temperature, electromagnetic radiation, current, and/or voltage. Any or all of these factors may be used to affect any or all of the aforementioned optical properties.

Light guide may be made out of any conventional optical material. Thus, e.g., it may be made out of polished metal-coated glass wherein the metal is selected from the group consisting of aluminum, silver, gold, copper, and other metals frequently used in optical mirrors. Thus, it may be made out one or more of such metals; it may, e.g., be aluminum sheet metal, copper sheet metal, etc.

Guide 32 also may be made out of glass and/or plastic. Alternatively, or additionally, it may be coated with a reflective material such as, e.g., aluminum, silver, gold, dielectric materials such as magnesium fluoride, and the like.

In one especially preferred embodiment, light guide 32 and/or diffuser 30 is comprised of an optical lighting film which contains one smooth surface and an opposing rough surface, the rough surface containing very precise prims. One particularly preferred embodiment of this light guide is sold by the Minnesota Mining and Manufacturing Company of Saint Paul, Minn. under the name of "Scotch Optical Lighting Film" (also referred to as "SOLF"). The "SOLF" material is described in bulletin 75-0299-6018-6 of Minnesota Mining and Manufacturing, the disclosure of which is hereby incorporated by reference into this specification.

U.S. Pat. Nos. 4,260,220, 4,542,449, 4,615,579, 4,750,798, and 4,791,540 describe the "SOLF" material; each of these patents was issued to Mr. Lorne A. Whitehead; and each of these patents is hereby incorporated by reference into this specification.

Thus, as described in U.S. Pat. No. 4,260,220, the light guide might comprise a longitudinal hollow structure made of transparent dielectric material, said structure having substantially planar inner and outer surfaces which are in octature. In one preferred embodiment of this patent, each wall section of the light guide has a planar inner surface and an outer surface having 90 degree angle longitudinal corrugations. In this embodiment, the light dielectric material is acrylic plastic or clear glass.

Thus, as described in U.S. Pat. No. 4,542,449, the material in the light guide may be comprised of a first and a second sheet of transparent dielectric material, each sheet having a first smooth surface and a second corrugated surface, wherein the surfaces of the corrugations interact at 90 degrees and the surfaces of the corrugations are at 45 degrees to the surfaces of the corrugations on the other side of each sheet. In this embodiment, the smooth surface of the first sheet forms the first face of the panel, the corrugated surface of the first sheet is adjacent to the smooth surface of the second sheet, with the direction of the corrugations on the second sheet set at a predetermined angle to the direction of the corrugations on the first sheet.

In one preferred embodiment, the "SOLF" material is a clear, 0.020" thick plastic film.

In one preferred embodiment, both the diffuser 30 and the light guide 32 contains said "SOLF" material; and, in both said diffuser and light guide, mixing of the separate wavelengths of the polychromatic light occurs, guiding of said light, and smoothing out of the light distribution occurs. The "SOLF" is especially effective for these functions. However, other materials, such as mirrors configured in a tubular shape or tubes formed of metal-coated plastic material or solid glass cylinders, also may adequately perform such function if their optical lengths are sufficient to adequately perform these functions. With a diffuser 30 and a light guide 32, a length of at least about 2 inches for the light guide is preferred.

In one embodiment, not shown, diffuser 30 is omitted from apparatus 10. In this embodiment, the light guide 32 conducts both the diffusing, guiding, and mixing operations.

Figure 4:
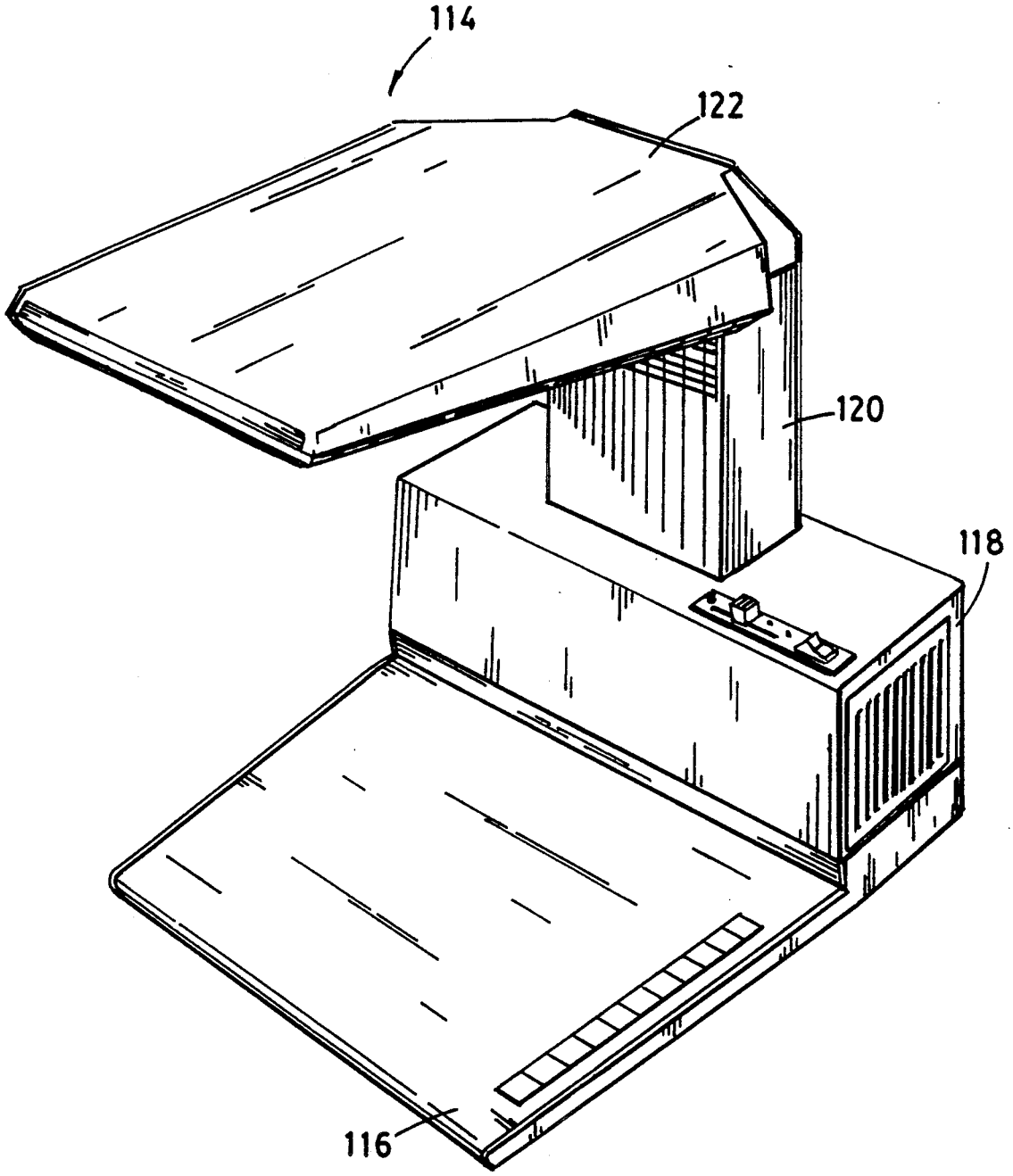
FIG. 4 is a perspective view of another preferred embodiment of the invention.

FIG. 4 illustrates another preferred embodiment of applicant's invention in which the light output is obtained by subtracting light from a light source using a filter. Referring to FIG. 4, daylight simulating lamp 114 is comprised of a base 116, a light source housing 118, a light guide 120, and a light hood 122. In the preferred embodiment shown in FIG. 4, each of elements 116, 118, 120, and 120 are operatively connected to each other and collectively form a housing.

Figure 5:
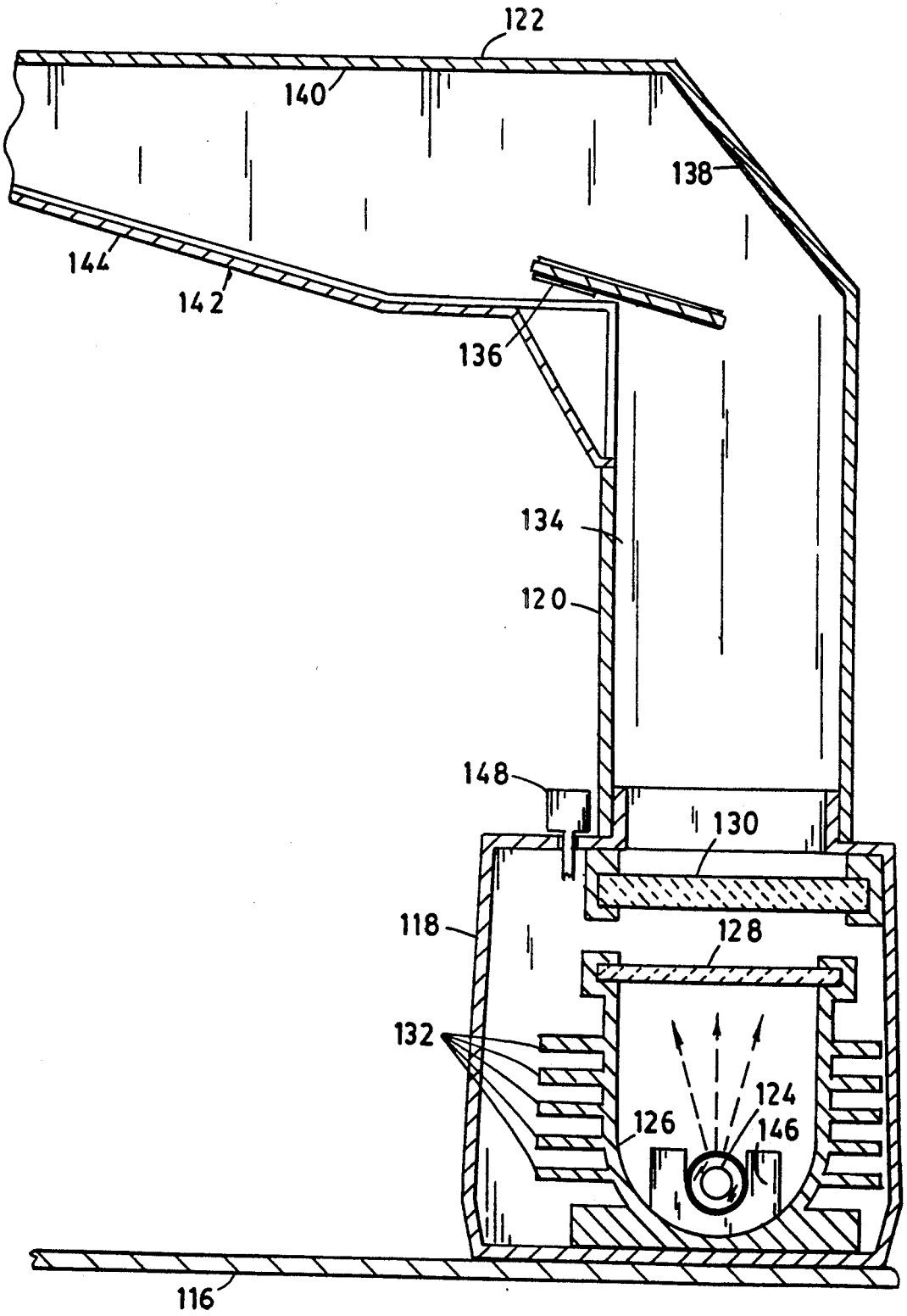
FIG. 5 is a side sectional view of the embodiment of FIG. 4.

FIG. 5 is a side sectional view of the embodiment of FIG. 4. Referring to FIG. 5, it will be seen that daylight simulating lamp 114 comprises light source 124, reflector/light guide 126, heat absorbing means 128, spectral modifying means 130, adjustable heat dissipating means 132, light guide 134, reflector 136, reflector 138, diffuser 140, diffuser 142, and aperture 144.

Once light passes through spectral modifying means 130, it contacts light guide 134 of element 120, which causes it to become randomized. Such light interacts with reflector 136 and/or reflector 138, which causes it to be reflected downward onto base 116; whereas reflector 136 reflects most of the light towards base 116, reflector 138 preferably reflects a portion of the light towards the diffusing inner surface 140 of hood 122. Diffuser 142 comprises an aperture 144, through which light may exit.

Light source 124 is substantially similar to light source 14 described above. It is also preferred, in this embodiment, that such light source provide a full and even spectrum of light.

Light source 124 is operatively connected to a power supply (not shown) which, preferably, delivers alternating current to the light source. Light source 124 should preferably be so chosen that it provides full and even polychromatic light over substantially the entire visible spectrum.

In the preferred embodiment of FIG. 5, light source 124 is captured by socket 146.

The rays from light source 124 are guided reflector/-light guide 126 which may be substantially the same as reflector/light guide 16. In the preferred embodiment shown in FIG. 5, reflector/light guide 126 is comprised of a multiplicity of heat dissipating fins 132, which help to dissipate the heat absorbed by the element 128. It is preferred that daylight lamp 114 also comprise a fan (not shown in FIG. 5) disposed near element 128. The heat dissipating fins 132 and/or the fan comprise the adjustable heat dissipating means 132. The heat absorbed the fins and/or drawn away by the fan may be used to dry various samples to be viewed with lamp 114, such as, e.g., paint samples.

The polychromatic light rays from lamp 124 are caused to impinge upon heat absorbing means 128. The function of heat absorbing means 128 is to remove the infrared radiation generated by light source 124. As known to those skilled in the art, such infrared radiation generally has a wavelength of from about 780 to about 1,000,000 nanometers. Thus, the light passing through heat absorbing means 128 will preferably have a wavelength of from about 380 to about 780 nanometers.

Any means well known to those skilled in the art may be used to remove the infrared radiation from the light. Thus, by way of illustration, one may use an optical glass filter.

As is known to those skilled in the art, these optical glass filters are distinguished by selective absorption of optical radiation. They are described, e.g., on pages H-354 to H-357 of said "The Photonics Design & Applications Handbook, " 35th edition, supra.

Optical glass filters which screen out infrared radiation are readily available. Thus, e.g., they may be purchased from Schott Glass Technologies, Inc., York Avenue, Duryea, Pa. One especially preferred Schott filter is catalog filter number KG4 with a thickness of 4.0 millimeters.

Heat absorbing means is disposed above lamp 124. In the preferred embodiment illustrated in FIG. 4, it is attached to reflector 126 by conventional means such as, e.g., adhesive, friction fit, and the like.

In one embodiment, wherein a light source with more infrared radiation is desired, heat absorbing means 128 is either omitted or so utilized as to pass a substantial portion of the infrared radiation through it.

The light passing through heat absorbing means 128 is in optical alignment with spectral modifying means 130. In one embodiment, the function of such spectral modifying means is to remove a specified amount of the red and blue light from the light impinging upon it. In this embodiment, the light impinging upon spectral modifying means 130 will generally contain substantially more red light and yellow light than blue light. Spectral modifying means 130 preferably removes a sufficient amount of the red light and yellow light so that the light passing through it contains no more red light than blue light, and no more yellow light than blue light.

In one embodiment, the light passing through spectral modifying means 130 have a spectral distribution such that the amplitude of each of its components is the following specified percentage of the maximum amplitude of the light. Violet light (from about 400 to 450 nanometers) has a peak amplitude of from 70 to 90 percent of the peak amplitude. Blue light (from about 450 to 500 nanometers) has a peak amplitude of from 92 to 100 percent of the peak amplitude. Green light (from about 500 to 575 nanometers) has a peak amplitude of from 85 to 92 percent of the peak amplitude. Yellow light (from about 575 to 590 nanometers) has a peak amplitude of from 80 to 85 percent of the peak amplitude. Orange light (from about 590 to 615 nanometers) has a peak amplitude of from 75 to 80 percent of the peak amplitude. Red light (from about 615 to 780 nanometers) has a peak amplitude of from 60 to 75 percent of the peak amplitude.

It is preferred that spectral modifying means 130 be adjustable so that one may modify the amount to which it attenuates various light fractions. Thus, referring to FIG. 5, knob 148 is operatively connected to spectral modifying means 130 and can be used to modify its filtering capabilities.

There are many conventional means known to those skilled in the art for modifying the properties of a spectral filter, such as the preferred Schott optical glasses. By way of illustration, one may change the position of the spectral filter vis-a-vis the light beams, one can change the angular disposition of the filter, and the like. In a preferred embodiment, illustrated in FIG. 6, the spectral filter 130 is moved in and out.

Figure 6:
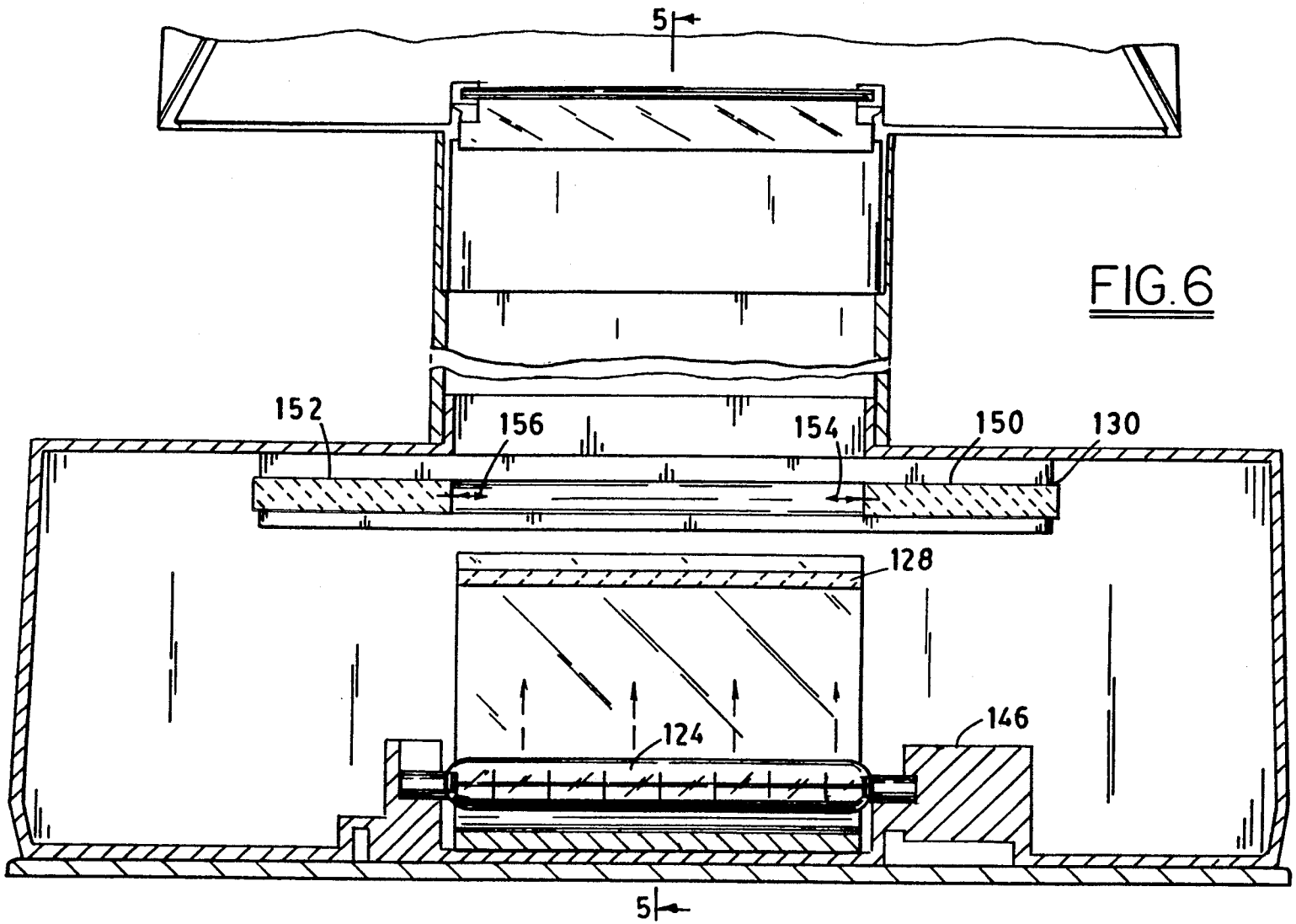
FIG. 6 is a front sectional view of the embodiment of FIG. 4.

Referring to FIG. 6, spectral filtering means 130 is comprised of glass optical filter 150 and glass optical filter 152. Each of optical filters 150 and 152 are operatively connected to knob 148. Movement of knob 148 can cause filter 150 to move towards or away from filter 152, and movement of such knob can cause filter 152 to move towards or away from filter 150; see, e.g., arrows 154 and 156.

In one embodiment, not shown, there is one adjustment knob for each of filters 150 and 152 so that the extent to which they are moved toward and/or away from each other may be—but need not be—the same.

In the embodiment shown in FIG. 6, filters 150 and 152 are in a position which will allow substantially all of the light from heat absorbing means 128 to pass. In another embodiment, not shown, filters 150 and 152 have been moved towards each other until they are substantially contiguous; in this embodiment, maximum attenuation occurs of the light passing from heat absorbing means 128.

It will be apparent to those skilled in the art that, by choosing the positioning of filters 150 and 152 and/or the position of light absorbing means 128 and/or the angular orientation of light absorbing means 128 and/or the thickness of light absorbing means 128 and/or filters 150 and/or 152 (which may be the same or be different), and/or the composition of the light absorbing means 128 and/or filters 150 and 152, one may substantially affect the nature of the light passing through spectral modifying means 130.

In one preferred embodiment, the thickness of filters 150 and 152 preferably will vary from about 5 to 15 millimeters and, preferably, from about 7 to about 11 millimeters. One preferred filter which may be used is Schott's filter glass FG6, which has a thickness of 9.1 millimeters. Each of filters 150 and 152 may have the same thickness. Alternatively, they may have different thicknesses, so that the spectral output will vary from one filter of like material to another.

The composition of heat absorbing filter 128 and optical filters 150 and 152 also will influence the type of light passing through such filters. In one embodiment, each of said filters consists essentially of a single phase material. In another embodiment, one or more of said filters consists of a multiplicity of phases. In yet another embodiment, one or more of such filters are made by coating part or all of a suitable transparent substrate with a dielectric interference filter material.

In one preferred embodiment, a composite filter is made by comminuting at least two different absorptive and/or reflective and/or refractive and/or diffractive materials and then mixing then together in different ratios. The mixture may then be made into a filter body by conventional means; thus, for a glass mixture, glass melting and quenching may occur. The filter body thus formed will have different optical properties at a multiplicity of different points in the body because, at many of such points, the composition of the body will vary. In one embodiment, two or more glass filters are separately smashed with a hammer and weighed, and the glass fragments are then suspended in an index matching cement to form the filter.

In another embodiment, a composite filter is formed by conventional means which contains several vertical and/or horizontal and/or diagonal layers of material with different optical properties. In yet another embodiment, the filter contains a substantially random arrangement of materials with different optical properties. In yet another embodiment, the filter contains portions of each of a reflective, an absorptive, a dispersive, and diffractive material.

The light which passes through spectral modifying means enters light guide 120. Light guide 120 may be an integral part of light source 118 and may comprise, together with said light source 118 and said hood 122, an integral structure. Alternatively, light guide 120 and/or hood 122 may be separately fabricated and joined together by conventional means such as, e.g., welding or adhering.

Light source 124 is connected to the base 116 and to reflector/light guide 126 by means of base 116. The precise means used to connect the parts of daylight simulating lamp 114 are not critical as long as (1) light source 124 remains optically aligned with reflector/-light guide 126, heat absorbing means 128, and spectral modifying means 130, (2) surface contact between the infrared filter and the reflector/light guide 126 exist so that a sufficient amount of heat will be dissipated from the filter.

It will be appreciated by those skilled in the art that the mechanism for producing a light distribution in this second embodiment differs from the mechanism used in the first embodiment. In said first embodiment, polychromatic light is first spatially separated into different wavelengths, the spatially separated wavelengths of light are then selectively attenuated, the attenuated wavelengths of light are then focused, the focused wavelengths of light are recombined, and the recombined wavelengths then scrambled in a manner designed to insure that the light does separate into distinct wavelengths. The scrambling of the recombined wavelengths increases the entropy of the light and helps to insure that it does separate into individual wavelengths. Various means of increasing the entropy of the system may also be used to help insure that the light does not separate into distinct wavelengths. Thus, in addition to the diffuse reflector illustrated in FIG. 1 (see element 30), one may also use diffuse transmitters (such as opal glass, frosted glass, bead blasted glass), integrating spheres, randomizing electric fields, and the like.

By comparison, in the second embodiment, the polychromatic light is first contacted with a means for removing light with a wavelength in excess of 780 angstroms. The filtered light is then selectively attenuated, the selectively attenuated light is then scrambled in a manner designed to increase its entropy and uniformity.

Referring again to FIG. 5, the light passing from spectral modifying means 130 is subjected to a randomizing treatment to increase its disorder. Any of the randomizing treatments known to those skilled in the art may be used. Thus, by way of illustration, one may use an integrating sphere, a diffuse reflector, diffuse transmitters (such as opal glass, frosted glass, bead blasted glass), randomizing electric fields, integrating light bars, lenticular lenses, and the like.

In one especially preferred embodiment, the interior surface 134 of the light guide 120 and/or the interior surface 140 of the hood 122 consists of a thin layer of said "SOLF" material. The smooth surface of said "SOLF" material preferably is what the light initially contacts; the rough, prism surface of the "SOLF" is preferably attached to the frames of the light guide 120 and hood 122.

The partially attenuated light passing through spectral modifying means 130 contacts the "SOLF" surfaces at various angles, places, and degrees; it is partially reflected and refracted by said surface; and it is substantially randomized by its multiple contacts with such surface.

In one embodiment, substantially all the entire interior surface of said light guide and hood is coated with said "SOLF" material, with the exception of the aperture defined by 144. In another embodiment, not shown, less than substantially 100 percent of the interior surface of said light guide and/or said hood is coated with said "SOLF" material. In one aspect of this latter embodiment, other randomizing materials may be used in place of some of the "SOLF" material. Thus, by way of illustration and not limitation, one may use "TEFLON" (tetrafluoroethylene fluorocarbon polymers, sold by the DuPont de Nemours Company of Wilmington, Del.), spectrally flat paints (such as white paint), and the like. It is preferred that, whatever randomizing material be used, it be spectrally flat, i.e., it not modify the wavelength composition of the light passing though filter 130.

The light guide 120 should be wide enough to capture substantially all of the light passing filter 130. The light passing filter 130 is first partially collimated by reflector 126 and, thus, passes in a band which is substantially as wide as the width of said reflector. The width of the light guide 120 thus should substantially equal to or greater than the width of said reflector. In one preferred embodiment, the interior width of said reflector is about 2.0 inches, and the interior width of the light guide 120 is 2.0 inches.

The light 120 should be long enough to effect a substantial amount of randomizing. It is preferred that light guide 120 be at least about 2.0 inches. It is also preferred that the combined length of the light guide and the hood 122 be at least about 4.0 inches. In a more preferred embodiment, the combined length of said hood 122 and light guide 120 is at least 6.0 inches.

Figure 7:
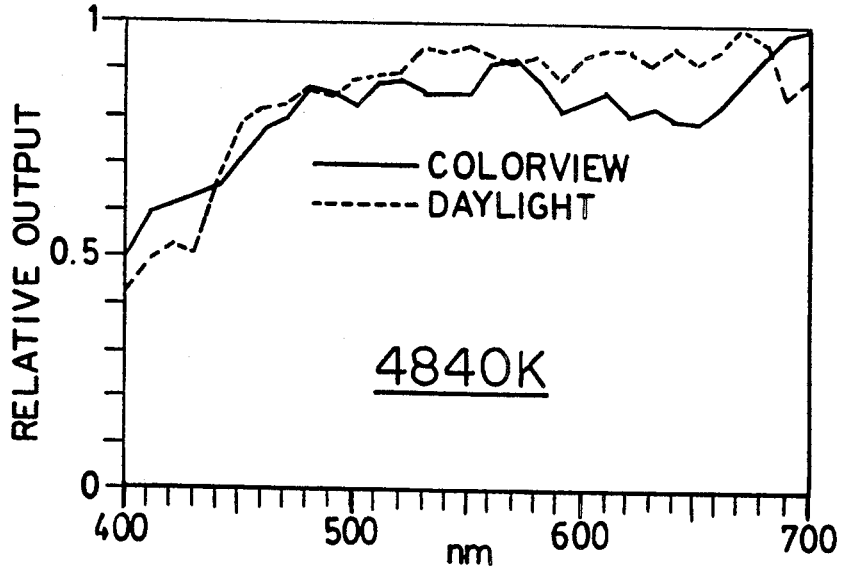
FIGS. 7, 8, and 9 are graphs of some spectra obtainable with the embodiment of FIG. 4 and illustrates how closely these spectra match daylight.

FIG. 7 is a graph illustrating, in broken line, the spectra which is generally present on a light haze day with a solar altitude of 40 degrees; the correlated color temperature of the daylight in this condition is generally about 4,840 degrees Kelvin. As is known to those skilled in the art, correlated color temperature is the color temperature of the point on the Planckian locus which is nearest to the chromaticity point for the course considered, on an agreed uniform chromaticity scale. See, e.g., page 315 of S. T. Henderson's Daylight & Its Spectrum Second Edition(John Wiley & Sons, New York, 1977), the disclosure of which is hereby incorporated by reference into this specification.

Referring to FIG. 7, it will be seen that the spectra obtained with the daylight lamp of FIG. 4 is substantially identical to the spectra of the light haze daylight, with a variance of 0.2392 from the range of 400 to 700 nanometers. This spectra was created with the lamp of FIG. 4 with spectra modifying filter 130 having a thickness of 9.1 millimeters and set so that 87.5 percent of the light passing the heat absorbing means 128 was intercepted by the filter 130.

Figure 8:
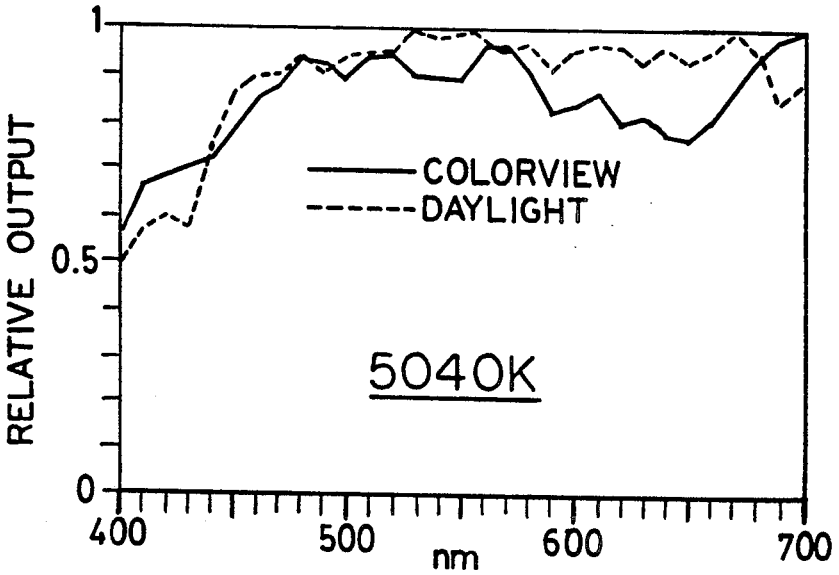

Referring to FIG. 8, it will be seen that the spectra obtained with the daylight lamp of FIG. 4 is substantially identical to the spectra of daylight on a day with very light to light clouds and at a solar altitude of 40 degrees with a variance of 0.2522 within the range of 400 to 700 nanometers; under these conditions, the daylight has a color temperature of about 5,040 degrees Kelvin. This spectra was created with the lamp of FIG. 4 with spectra modifying filter 130 having a thickness of 9.1 millimeters and set so that 90.5 percent of the light passing the heat absorbing means 128 was intercepted by the filter 130.

Figure 9:
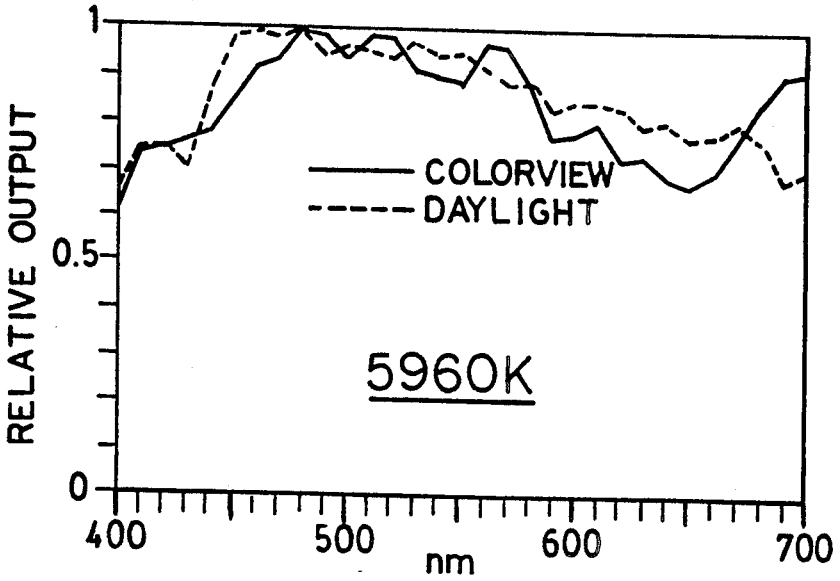

Referring to FIG. 9, it will be seen that the spectra obtained with the daylight lamp of FIG. 4 is substantially identical to the spectra of daylight on a clear day and at a solar altitude of 40 degrees with a variance of 0.2240 within the range of 400 to 700 nanometers; under these conditions, the daylight has a color temperature of about 5,960 degrees Kelvin. This spectra was created with the lamp of FIG. 4 with spectra modifying filter 130 having a thickness of 9.1 millimeters and set so that 95.0 percent of the light passing the heat absorbing means 128 was intercepted by the filter 130.

Figure 10:
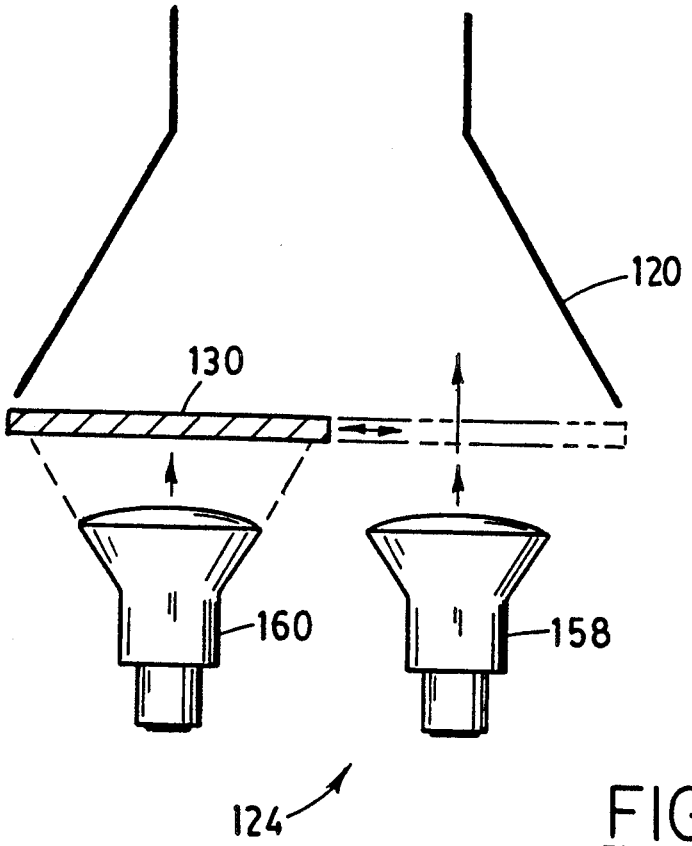
FIG. 10 is partial schematic of an alternative light source which may be used in the embodiment of FIG. 4.

FIG. 10 is a partial schematic of an alternative light source which any be used in the embodiment of FIG. 4. In this embodiment, the light source 124 is comprised of at least two lamps, lamp 158 and lamp 160. These lamps may provide the same light output or different light output. In one preferred aspect of this embodiment, the lamps 158 and 160 provide different spectral output.

The output from lamps 158 and 160 is optically aligned with aperture/light guide/mixing chamber 120. Filter 130, which may block passage of some or all of the infrared radiation and/or attenuate other portions of the light spectrum, is movably mounted within light guide 120 so that its position vis-a-vis lamps 158 and 160 may be adjusted. By making appropriate adjustments in the position of the filter, and/or in its angular orientation, and/or the power supplied to lamp 158 and/or 160, differing spectras can be caused to flow into light guide 120, wherein they may be randomized as before to produce a uniform output beam.

The randomization which occurs in applicant's process has several beneficial effects. In the first place, because it increases the entropy of the system, it tends to prevent the attenuated light from separating into its component parts (i.e., separate wavelengths or beams of light exhibiting discrete spectral characteristics.). In the second place, it tends to make the amplitude and/or intensity of the light distribution more uniform. In the third place, it provides more flexibility in the possible degrees of attenuation that a spectrally modifying element (such as element 130) may provide.

Referring again to FIG. 10, the configuration shown may also be used in a wall-mounted or ceiling mounted embodiment of the daylight lamp of FIG. 4. Such a preferred embodiment may be used to provide the spectral components normally missing from artificial light (such as, e.g., the yellow component missing from the "CHROMALUX" lamp's output) which is present in the daylight environment.

In one preferred embodiment, partially illustrated in FIG. 10, the lamp 158 is an incandescent lamp (such as Duro-Test "Watt-SavER-30 Super White), lamp 160 is a "CHROMALUX" lamp, the filter 130 is an opaque aperture whose width is equal to the width of the light band emitted from lamps 158 and/or the light band emitted from lamp 160 and/or the distance between lamps 158 and 160. The thickness of filter 130 is preferably from about 1 to about 5 millimeters.

In one embodiment, not shown, filter 130 is comprised of one or more orifices which freely allow the passage of light therethrough. In another embodiment, filter 130 consists of a composite material and contains a multiplicity of phases, as described before.

In one embodiment, not shown, the light guide 120 is omitted. In this embodiment, the optical path length is sufficiently long to effect substantial mixing of the two light beams and randomization of their respective spectral outputs. distance between the light source (158 and 160) and the object being illuminated is such sufficiently large.

Figure 11:
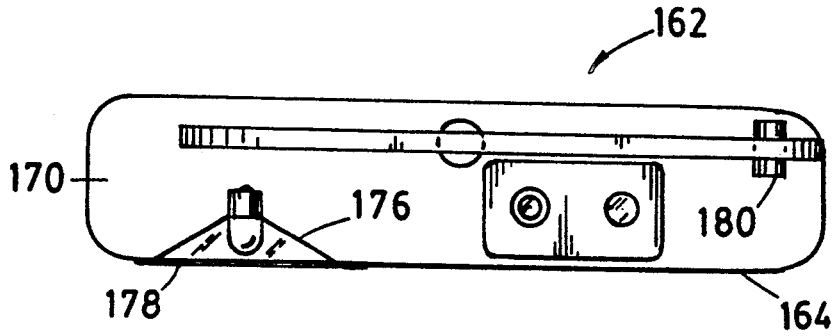
FIG. 11 is a top view of a third embodiment of this invention.
Figure 12:
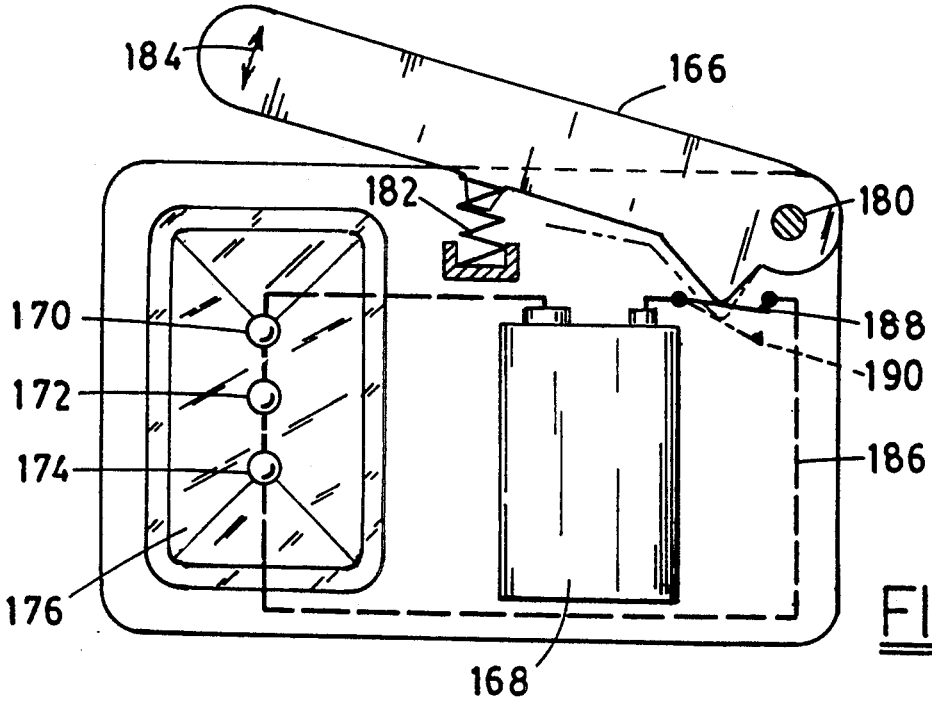
FIG. 12 is a side view of the embodiment of FIG. 11.
Figure 13:
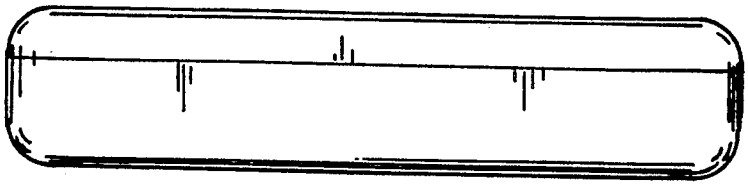
FIG. 13 is a bottom view of the embodiment of FIG. 10.

FIGS. 11, 12, and 13 disclose another preferred embodiment of this invention. Lamp 162 is comprised of case 164, switch assembly 166, power supply 168, lamps 170, 172, and 174, reflector 176, diffuser 178, and aperture 180.

Referring to FIG. 11, lamp 162 is preferably comprised of a substantially rectangular case 164 on the top of which, 170, is located a switch 166.

One preferred embodiment of switch 166 is shown in the sectional view of FIG. 12. Switch 166 is pivotally connected at point 180 to case 164. At about the midpoint 182 of switch 166, a spring is attached to the switch 166 and to case 164 to insure that the switch is normally in the open position. In other embodiment, not shown, the elastic properties of switch 166 and case 164 and their relative position tend to insure that switch 166 is normally in the open position.

When switch 166 is depressed in the direction of arrow 184, circuit 186 is opened; switch 188 is depressed to position 190. In another embodiment, not shown, the depression of switch 166 turns a circuit from a normally off position to an on position. These circuits and switches are well known to those skilled in the art and are described in Rudolf A. Graf's "The Encyclopedia of Electronic Circuits," (Tab Books Inc., Blue Ridge Summit, Pa., 1985), the disclosure of which is hereby incorporated by reference into this specification.

Power supply/battery 168 provides sufficient direct current to lamps 170, 172, and 174 to illuminate them. These lamps may all provide substantially the same spectral output. Alternatively, one or more of these lamps 170, 172, and 174 may provide different spectral output.

Reflector 176 tends to improve the directional output efficiency of lamps 170, 172, and 174. Such light is caused to impinge upon diffuser 178, which tends to randomize the light.

The diffuser 178 may be any means which increases the entropy of the light output. Any of the entropy-increasing means described above for the other embodiments of this invention may be used as diffuser 178. In one preferred embodiment, a textured translucent plastic material is used.

In one embodiment, not shown, there is a means (not shown) for attaching lamp 162 to a surface, such as a wall, the interior of a dresser, etc. In one embodiment, lamp 162 is attached to a the interior surface of the drawer of a dresser; in this embodiment, the opening of said drawer closes the circuit and turns on the lamp, also lamp 162 may contain a mirror to create an image of an illuminated object illuminated by lamp 162.

The following Example is presented to illustrate the claimed invention but is not to be deemed limitative thereof.

EXAMPLE

A Kodak Carousel Custom, model number 850H (available from the Eastman Kodak Company of Rochester, N.Y.) equipped with a standard incandescent projection bulb, was connected to a source of 120-volt alternating current; and it was used as light source 14 and reflector 16 in the embodiment of FIG. 1.

The light coming from the Carousel was focused using a bi-convex lens with a focal length of 2.0 inches and clear aperture of 2.0 inches. The light thus focused was directed into a substantially rectangular aperture with dimensions of 1.0 millimeter × 5.0 millimeters. This aperture, the holographic grating referred to below, and the aperture through which the diffracted light was selectively attenuated by were all part of the "Chemspec" 100S housing (available from the American Holographic Company, Littleton, Ma.). The holographic grating used in this experiment was an American Holographic grating, catalog number 450.02.

The light passing through the aperture was dispersed by the flat field concave holographic grating described above. The dispersed light was caused to impinge upon the exit aperture of the Chemspec. This exit aperture was substantially rectangular, with dimensions of 5 millimeters by 35 millimeters.

The light passing through the exit aperture was selectively attenuated by being caused to impinge upon an opaque piece of cardboard which was large enough to cover the width of the aperture; and the aperture was tilted so that the red portion of the spectrum was attenuated more than the blue portion.

The resultant beam exiting from the aperture was then focused by a bi-convex lens with a 2.0 inch focal length and a 2.0 inch clear aperture and imaged upon a lambertian reflector which was about 1.5" by 3.0". The resultant randomized beam was viewed by the applicant and found to be an accurate simulation of daylight.

In the prior portion of this specification, applicant has defined many different embodiments of his invention. In the remainder of this specification, he will try to summarize features which are common to some of the more preferred of these embodiments.

Thus, for example, one may use a random bundle of fibers as diffuser 30.

Thus, for example, light source housing 118 may be used with other bases, light guides, or light hoods to create other types of lamps such as, e.g., a museum lamp, a cosmetic lamp, a dental lamp, a household lamp, and the like. Each of these lamps utilize the same "engine."

Both the first and second embodiments of applicant's invention are comprised of at least one means for providing at least one beam of polychromatic light with a continuous spectral width of at least one nanometer and a wavelength of from about 1 to about 1,000,000 nanometers.

The light provided by such means is polychromatic. Thus, as is used in this specification, the term "polychromatic" refers to light which is composed of multiple frequencies of light; see, e.g., Max Born et al.'s "Principles of Optics," Sixth Edition (Pergamon Press, Oxford, 1984), pages 494–505, the disclosure of which is hereby incorporated by reference into this specification. The term "light beam," as used in this specification, refers to a collection of light rays which correspond to the direction of flow of radiant energy; see, e.g., E. Hecht et al.'s "Optics" (Addison-Wesley Publishing Company, Menlo Park, Calif., 1979), the disclosure of which is hereby incorporated by reference into this specification.

The width of the light beam, and its wavelength, may be measured with a spectroradiometer. Any of the spectroradiometers readily available to those skilled in the art may be used. Thus, e.g., one may use a "SPEX 500M" spectroradiometer available from Spex Industries, Inc., 3880 Park Avenue, Edison, N.J. The use of such spectroradiometer is described in, e.g., the manual provided with the machine, and in K. I. Tarasov's "The Spectroscope" (John Wiley & Sons, New York, 1974), pages 17–29, the disclosure of which is hereby incorporated by reference into this specification.

It will be apparent to those skilled in the art that applicant's apparatus may contain one or several means for providing said polychromatic light beam.

The second element of applicant's first and second embodiments is means for guiding said beam of polychromatic light. Any guiding means, such as the reflectors and light guides discussed in other portions of the specification, may be used. One such guiding means may be used, such as gradient index optical fibers, mirrors, and the like.

The third element of applicant's first embodiment is means for spatially dispersing said polychromatic light beam into its constituent element frequencies. Such dispersing may be effected by, e.g., the diffraction grating described in this specification. Alternatively, or additionally, it may be effected by prisms, slits, etc. As is well known to those skilled in the art, one may determine whether such spatial dispersion has occurred by means of a spectradiometer. See, e.g., pages 7–16 of the Tarasov book.

The fourth element of applicant's first embodiment is means for selectively attenuating said spatially dispersed beam of polychromatic light; such means preferably is adjustable. One may determine whether a light beam has been selectively attenuated with a particular means by using the aforementioned spectroradiometer. If the light beam is sampled before it impinges upon the selective attenuation means, and thereafter, and the spectra obtained by these analyses is compared, attenuation will be found to occur when the spectra of the light passing through the attenuation means has at least one of its frequencies with a substantially different intensity then the frequency had prior to attenuation. The light beam is selectively attenuated when at least one of its frequencies is altered to an extent different than another one of its frequencies.

The next element in applicant's first embodiment is means for converting said selectively attenuated spatially dispersed beam of polychromatic light into randomized light. As is known to those skilled in the art, such randomized light is characterized by the superposition of many waves with random phases. See, e.g., pages 244–250 of F. A. Jenkins "Fundamentals of Optics," Fourth Edition (McGraw-Hill Book Company, New York, 1976), the disclosure of which is hereby incorporated by reference into this specification.

In one embodiment, one may determine whether a randomized beam of light is present by testing the frequency distribution of such light with a spectroradiometer; measurements are taken at different settings and positions, and then the results of the measurements are compared. In the test used, the light to be tested is evaluated first with a spectroradiometer aperture setting designed to capture at least 90 percent of the radiant energy of the light being emitted; the measurement at this aperture setting should be made substantially flush to the emitting surface of the randomizer. The light to be tested is also evaluated with a second spectroradiometer aperture setting designed to capture no more than about 10 percent of the radiant energy of the light being emitted from the randomizer; the measurement at this second setting should be made at least 1.0 inch away from the point at which the measurement of the first setting was made. The measurement position in each case, however, will be determined by the specific applications. The light is randomized when the measurements at both the first setting and the second setting show substantially the same spectral frequency distribution. As used in this specification, the term "substantially the same spectral frequency" refers to a frequency distribution within ten percent mean variance across the applicable spectrum and aperture.

Applicant's second embodiment is similar to his first embodiment. Thus, this embodiment also includes at least one means for providing at least one beam of said polychromatic light; and it also includes means for guiding said beam of light. However, unlike the first embodiment (in which a spatially separated beam of light is first attenuated and then randomized), in this embodiment a portion of a beam of polychromatic light (which need not be spatially separated) is first selectively attenuated, and then light so selectively attenuated is then randomized.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. An apparatus for providing a light distribution, comprising:

(a) means for providing at least one beam of polychromatic light with a continuous spectral line width of at least one nanometer and a wavelength of from about 1 to about 1,000,000 nanometers;

(b) means for guiding said beam of polychromatic light;

(c) adjustable means for selectively attenuating spectral component frequencies of a portion of said beam of polychromatic light wherein 1. said means for selectively attenuating spectral component frequencies attenuates red light more than it attenuates orange light;
2. said means for selectively attenuating spectral component frequencies attenuates orange light more than it attenuates yellow light;
3. said means for selectively attenuating spectral component frequencies attenuates yellow light more than it attenuates green light;
4. said means for selectively attenuating spectral component frequencies attenuates green light more than it attenuates blue light;

5. said means for selectively attenuating spectral component frequencies attenuates blue light more than it attenuates violet light;

(d) means for increasing the entropy of an attenuated beam of polychromatic light to effect randomization of spectral frequencies, wherein said means for increasing the entropy of an attenuated beam of polychromatic light is comprised of a lenticular lens;

(e) means for varying the color temperature of said beam of polychromatic light, wherein:

1. said means for varying the color temperature is comprised of at least two optical filters and means for simultaneously moving each of said optical filters in different directions, wherein:

(a) said means for moving each of said optical filters in different directions is comprised of a knob, which is operatively connected to each of said optical filters, wherein movement of said knob causes movement of both of said optical filters, thereby changing the distance between said filters and the extent to which said filters interact with said beam of polychromatic light.

2. The apparatus as recited in claim 1, wherein said apparatus is comprised of means for removing light from said beam of polychromatic light which has a wavelength in excess of 780 angstroms.

3. The apparatus as described in claim 1, wherein said apparatus is comprised of means for shaping said randomized beam of polychromatic light.

4. The apparatus as recited in claim 1, wherein said apparatus is comprised of an optical filter which blocks the transmission of at least about 5 percent of light with a wavelength of from about 500 to about 575 angstroms.

5. An apparatus for providing a light distribution, comprising:

(a) means for providing at least one beam of polychromatic light with a continuous spectral line width of at least one nanometer and wavelength of from about 1 to about 1,000,000 nanometers;

(b) means for guiding said beam of polychromatic light;

(c) adjustable means for selectively attenuating spectral component frequencies of a portion of said beam of polychromatic light;

(d) means for increasing the entropy of an attenuated beam of polychromatic light to effect randomization of spectral frequencies, and (e) means for focusing randomized polychromatic light.

* * * * *